US010875345B2

(12) United States Patent
Zhou et al.

(10) Patent No.: US 10,875,345 B2
(45) Date of Patent: Dec. 29, 2020

(54) PRINTABLE RECORDING MEDIA

(71) Applicant: Hewlett-Packard Development Company, L.P., Houston, TX (US)

(72) Inventors: Xiaoqi Zhou, San Diego, CA (US); Xulong Fu, San Diego, CA (US); Haowen Yu, San Diego, CA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 85 days.

(21) Appl. No.: 15/769,675

(22) PCT Filed: Nov. 6, 2015

(86) PCT No.: PCT/US2015/059431

§ 371 (c)(1),
(2) Date: Apr. 19, 2018

(87) PCT Pub. No.: WO2017/078728

PCT Pub. Date: May 11, 2017

(65) Prior Publication Data

US 2019/0202225 A1 Jul. 4, 2019

(51) Int. Cl.
*B41M 5/50* (2006.01)
*B41M 5/52* (2006.01)

(52) U.S. Cl.
CPC ..... *B41M 5/506* (2013.01); *B41M 5/502* (2013.01); *B41M 5/504* (2013.01); *B41M 5/508* (2013.01); *B41M 5/52* (2013.01); *B41M 5/5218* (2013.01); *B41M 5/5236* (2013.01); *B41M 5/5245* (2013.01); *B41M 5/5254* (2013.01); *B41M 2205/34* (2013.01); *B41M 2205/42* (2013.01)

(58) Field of Classification Search
CPC .... B41M 5/502; B41M 5/504; B41M 5/5227; B05D 1/00; B05D 3/00
USPC ..... 428/32.25
See application file for complete search history.

(56) References Cited

U.S. PATENT DOCUMENTS 6,096,469 A * 8/2000 Anderson ..... B41M 5/52 423/335
6,357,871 B1 3/2002 Ashida et al.
6,841,208 B2 1/2005 Farooq
7,335,407 B2 2/2008 Landry-Coltrain et al.
(Continued)

FOREIGN PATENT DOCUMENTS

EP 0903246 3/1999
EP 1284199 2/2003
(Continued)

OTHER PUBLICATIONS

International Search Report and Written Opinion for International Application No. PCT/US2015/059431 dated Jul. 29, 2016, 10 pages.

*Primary Examiner* — Betelhem Shewareged
(74) *Attorney, Agent, or Firm* — HP Inc. Patent Department

(57) ABSTRACT

Disclosed herein is a printable recording media comprising a cellulose based substrate and a composite ink receiving layer that includes a first distinct layer and a second distinct layer. The second distinct layer is applied on top of the first distinct layer and comprises, at least, a polymeric binder, nano-size inorganic pigment particles and an ionene compound. Also disclosed herein is a method for making the printable recording media.

17 Claims, 2 Drawing Sheets

(56) References Cited

U.S. PATENT DOCUMENTS

| | | | | |
|---|---|---|---|---|
| 7,370,959 | B2 | 5/2008 | Kobayashi et al. | |
| 7,658,981 | B2 | 2/2010 | Teramae | |
| 8,071,201 | B2 | 12/2011 | Leenders et al. | |
| 8,092,874 | B2 | 1/2012 | Wexler et al. | |
| 8,198,213 | B2 | 6/2012 | Sekiya et al. | |
| 8,357,438 | B2 | 1/2013 | Asao et al. | |
| 2002/0045035 | A1* | 4/2002 | Nojima | B41M 5/508 428/32.25 |
| 2003/0112311 | A1 | 6/2003 | Naik et al. | |
| 2003/0203133 | A1* | 10/2003 | Maekawa | B32B 27/10 428/32.1 |
| 2006/0159873 | A1 | 7/2006 | Chang et al. | |
| 2007/0237910 | A1 | 10/2007 | Zhou et al. | |
| 2009/0109270 | A1 | 4/2009 | Kobayashi | |
| 2009/0214805 | A1 | 8/2009 | Kobayashi | |
| 2009/0246386 | A1 | 10/2009 | Kaimoto et al. | |
| 2010/0033527 | A1 | 2/2010 | Kawakami et al. | |
| 2010/0075045 | A1 | 3/2010 | Kaimoto et al. | |
| 2011/0104408 | A1 | 5/2011 | Wang et al. | |
| 2014/0139601 | A1 | 5/2014 | Pal et al. | |
| 2014/0141212 | A1 | 5/2014 | Fu et al. | |
| 2015/0298478 | A1 | 10/2015 | Nagoshi | |
| 2019/0202224 | A1* | 7/2019 | Fu | B41M 5/502 |
| 2019/0202225 | A1* | 7/2019 | Zhou | B41M 5/506 |

FOREIGN PATENT DOCUMENTS

| | | |
|---|---|---|
| EP | 1329330 | 7/2003 |
| EP | 1570999 | 9/2005 |
| EP | 1658994 | 5/2006 |
| EP | 2719543 | 4/2014 |
| JP | H08164665 | 6/1996 |
| WO | WO-2014027614 | 2/2014 |
| WO | WO-2016119895 | 8/2016 |
| WO | WO-2016122485 | 8/2016 |
| WO | WO-2016130158 | 8/2016 |

* cited by examiner

PRINTABLE RECORDING MEDIA

BACKGROUND

Inkjet printing is a non-impact printing method in which an electronic signal controls and directs droplets or a stream of ink that can be deposited on a variety of substrates. Current inkjet printing technology involves forcing the ink drops through small nozzles by thermal ejection, piezoelectric pressure or oscillation, onto the surface of a media. This technology has become a popular way of recording images on various media surfaces, particularly paper, for a number of reasons, including low printer noise, capability of high-speed recording and multi-color recording. Inkjet web printing is a technology that is specifically well adapted for commercial and industrial printing. Example of such printing technology is the "HP Page Wide Array printing" where more than hundreds of thousand tiny nozzles on a stationary print-head that spans the width of a page, delivering multi-colors ink onto a moving sheet of paper under a single pass to achieve the super-fast printing speed.

With these printing technologies, it is apparent that the image quality of printed images is dependent on the construction of the recording media used. Accordingly, investigations continue into developing printable recording media that can be effectively used with such technology and which impart good printing performances.

BRIEF DESCRIPTION OF THE DRAWING

The drawings illustrate various examples of the present recording media and are part of the specification.

DETAILED DESCRIPTION

Figure 1:
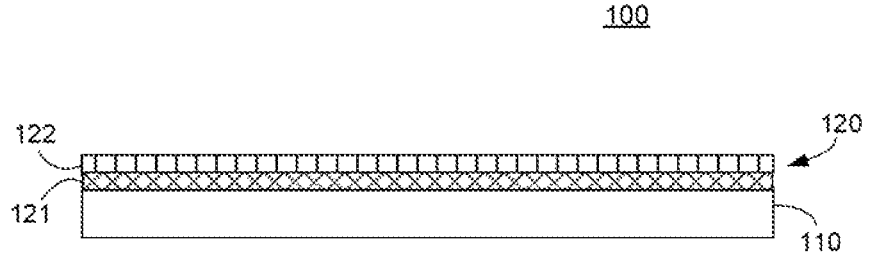
FIGS. 1, 2 and 3 are cross-sectional views of the printable recording media according to examples of the present disclosure.

The present disclosure refers to a printable recording media comprising a cellulose based substrate and a composite ink receiving layer with a first and a second distinct layer, wherein the second distinct layer is applied on top of the first distinct layer and contains, at least, a polymeric binder, nano-size inorganic pigment particles and an ionene compound. The present disclosure refers also to a method for making the printable recording media.

Before particular examples of the present disclosure are disclosed and described, it is to be understood that the present disclosure is not limited to the particular process and materials disclosed herein. It is also to be understood that the terminology used herein is used for describing particular examples only and is not intended to be limiting, as the scope of protection will be defined by the claims and equivalents thereof. In describing and claiming the present article and method, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For examples, a weight range of about 1 wt % to about 20 wt % should be interpreted to include not only the explicitly recited concentration limits of 1 wt % to 20 wt %, but also to include individual concentrations such as 2 wt %, 3 wt %, 4 wt %, and sub-ranges such as 5 wt % to 15 wt %, 10 wt % to 20 wt %, etc. All percent are by weight (wt %) unless otherwise indicated. As used herein, "image" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

In some examples, the printable recording media is an inkjet printable media. The media can thus be specifically designed to receive any inkjet printable ink, such as, for example, organic solvent-based inkjet inks or aqueous-based inkjet inks. Examples of inks that may be deposited, established, or otherwise printed on the printable substrate, include pigment-based inkjet inks, dye-based inkjet inks, latex-based inkjet inks and UV curable inkjet inks. In some examples, the printable recording media is an inkjet printable media specifically adapted to be printed with pigment-based inks and/or dye-based inks. In some other examples, the printable recording media is an inkjet printable media specifically adapted to be printed with dye-based inks. In some examples, the printing inks that can be used are pigmented inks, and, in other examples, the printing inks that can be used are dye based inks.

The printable recording media, described herein, provides printed images and articles that demonstrate excellent image quality (such as vivid color gamut, low ink bleed and good coalescence performance) while enabling high-speed printing. By high-speed printing, it is meant herein that the printer can generate up to 30 sheet of arch D size (610 mm×915 mm) per minute with full colored images for examples. The printable recording media can be also used for the large format size printing (such large format printer that generate, for examples, 54" wide print-out). The printable recording media provides printed images that can be present in various surface finishing such as matt, satin and gloss. The recording media can also be textured to create various art effects. In some examples, the images printed on the recording media, such as described herein, are able to impart excellent image quality: provides vivid color, such as higher gamut and have a different levels of gloss, and high color density. High print density and color gamut volume are realized with substantially no visual color-to-color bleed and with good coalescence characteristics. In addition, the printable media has an optimized absorption rate. By "optimized absorption rate", it is meant that the water, solvent and/or vehicle of the ink can be absorbed by the media at a fast rate so that the ink composition does not have a chance to interact and cause bleed and/or coalescence issues and also not caused any ink transfer to any rollers inside the paper path of the printer. On another hand, the recording media is also constructed in order to avoid any excessive absorption of the ink colorant (pigments or dyes) so that ink optical density and color gamut are decreased. The faster the printing speed and the higher the amount of ink used, the higher is the demand on faster absorption from the media. A good diagnostic plot with maximum ink density, such as secondary colors, would be prone to coalescence and a pattern of lines of the primary and secondary colors passing through area fills of primary and secondary colors would be prone to bleed. If no bleed or coalescence is present at the desired printing speed, the absorption rate would be sufficient. Bristow wheel measurements can be used for a quantitative measure of absorption on media wherein a fixed amount of a fluid is applied through a slit to a strip of media that moves at varying speeds. In some examples, the printing substrate has an ink absorption rate that is not less than 35 ($mL/m^2$)/sec, as measured by Bristow wheel ink absorption method. (The Bristow wheel is an apparatus also called the Paprican Dynamic Sorption Tester, model LBA92, manufactured by Op Test Equipment Inc.)

In some examples, the printing substrate has a surface smoothness that is less than 150 Sheffield smoothness unites. In some other examples, the printing substrate has a surface smoothness that is less than 100 Sheffield smoothness unite. In yet some other examples, the printing substrate has a surface smoothness that ranges between from about 30 to about 60 Sheffield smoothness unite. The Surface smoothness is measured with a Hagerty smoothness tester (Per Tappi method of T-538 om-96). This method is a measurement of the airflow between the specimen (backed by flat glass on the bottom side) and two pressurized, concentric annular lands that are impressed into the sample from the top side. The rate of airflow is related to the surface roughness of paper. The higher the number is, the rougher the surfaces. The unit is SU (Sheffield smoothness unit).

In some examples, the printable recording media used herein is a coated glossy media that can print at speeds needed for commercial and other printers such as, for example, a Hewlett Packard (HP) Inkjet Web Press (Hewlett Packard Inc., Palo Alto, Calif., USA). The properties of the print media in accordance with the principles described herein are comparable to coated media for offset printing. The printable recording media can have a 75° gloss (sheet gloss) that is greater than 30%; or that is greater than 45%. Such gloss is referred as the "Sheet Gloss" and measures how much light is reflected with a 75 degree (o) geometry on the unprinted recording media. 75° Sheet Gloss testing is carried out by Gloss measurement of the unprinted area of the sheet with a BYK-Gardner Micro-Gloss 75o Meter (BYK-Gardner USA, Columbia, Md., USA).

The printable recording media, described herein, provides printed images that demonstrate excellent image quality (good bleed and coalescence performance), enhance durability performance while enabling high-speed and very high-speed printing and using either pigment based inks or dye based inks. By high-speed printing, it is meant herein that the printing method can be done at a speed of 50 fpm or higher. As durability performance, it is meant herein that the resulting printed images are robust to dry and wet rubbing that can be done by going through finishing equipment (slitting, sheeting, folding, etc.) or by the user.

The printable recording media according to the present disclosure provides printed images that have outstanding print durability and excellent scratch resistance while maintaining good jettability. By scratch resistance, it is meant herein that the composition is resistant to all modes of scratching which include, abrasion and burnishing. By the term "abrasion", it is meant herein the damage to a print due to wearing, grinding or rubbing away due to friction. Abrasion is correlated with removal of colorant (i.e. with the OD loss). An extreme abrasive failure would remove so much colorant that the underlying white of the paper would be revealed. The term "burnishing" refers herein to changing the gloss via rubbing. A burnishing failure appears as an area of differential gloss in a print.

Figure 2:
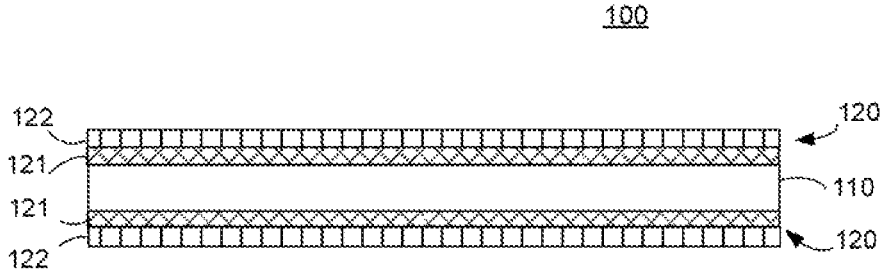
Figure 3:
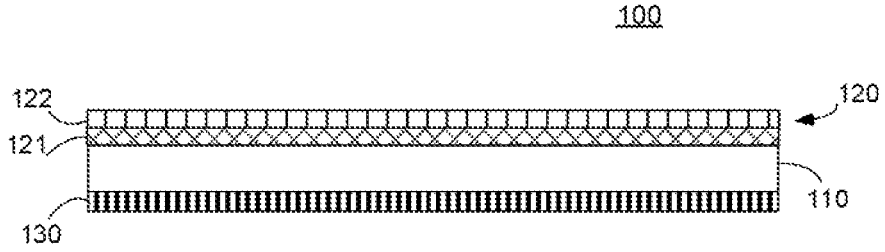
Figure 4:
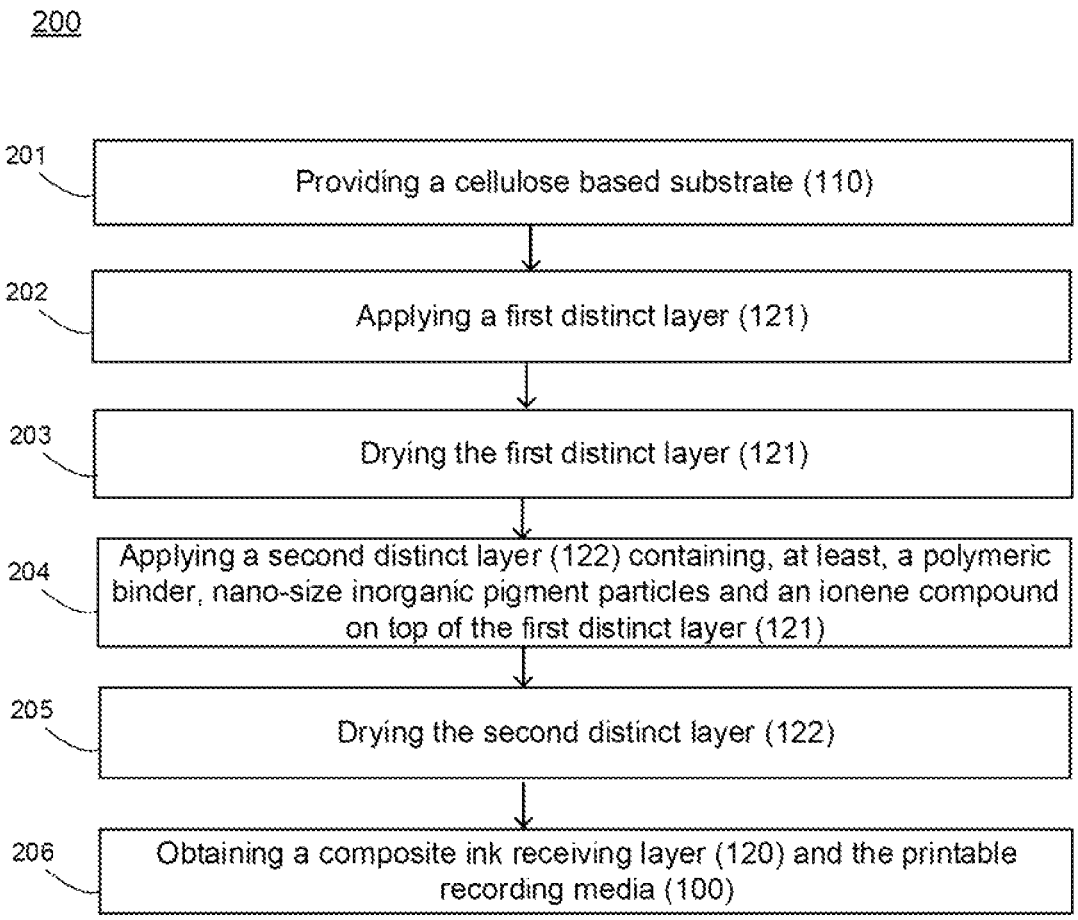
FIG. 4 is a flow chart of a method for making a printable recording media in accordance with an example of the present disclosure.

FIG. 1, FIG. 2 and FIG. 3 illustrate the printable recording media (100) as described herein. In some examples, as illustrated in FIG. 1, the printable media (100) encompasses a cellulose based substrate (110) and a composite ink receiving layer (120). The composite ink receiving layer (120) is made of a first distinct layer (121) and of a second distinct layer (122). The ink receiving layer (120) is applied on, at least, one side of the substrate (110). The image receiving layer can thus be applied on one side only and no other coating is applied on the opposite side. In some other examples, such as illustrated in FIG. 2, the composite ink receiving layer (120) is applied to both opposing sides of the cellulose based substrate (110). The double-side coated media has thus a sandwich structure, i.e. both sides of the cellulose based substrate (110) are coated and both sides may be printed. If the coated side is used as an image-receiving side, the other side, i.e. backside, may not have any coating at all, or may be coated with other chemicals (e.g. sizing agents) or coatings to meet certain features such as to balance the curl of the final product or to improve sheet feeding in printer. In yet some examples, such as illustrated in FIG. 3, the printable recording media (100) contains a composite ink receiving layer (120) on one side of the cellulose based substrate (110) and a backing coating layer (130) on the other side of the substrate, i.e. the side that will not receive any image (non-imaging side or backside). Such backing coating layer will help to balance coating stress to prevent media curling. As illustrated in FIGS. 1, 2 and 3, the printable media (100) encompasses a cellulose based substrate (or bottom supporting substrate) (110) and a composite ink receiving layer (120) that is made of a first distinct layer (121) and of a second distinct layer (122). FIG. 4 is a flow chart of a method for making the printable recording media in accordance with an example of the present disclosure.

The present disclosure refers to a printable recording media that comprises a cellulose based substrate and, at least, a composite ink receiving layer. The ink receiving layer is made of two distinct layers: a first layer or "ink fixation layer", and, applied on top of the cellulose based substrate, a second distinct layer or "ink fusion layer" containing, at least, a polymeric binder and nano-size inorganic pigment particles. The printable media, as described herein, can be considered as an article or as a coated article. The article comprises a cellulose paper substrate having, on its image side (or image receiving side), an ink fixation layer and an ink fusion layer wherein the ink fusion layer comprises an ionene compound in an amount representing from about 0.5 to about 20 parts per 100 parts by total dry weight of the coating components present in the second distinct layer.

The Cellulose Based Substrate

As illustrated in FIG. 1, the printable media (100) contains a cellulose based substrate (110) that supports the ink receiving layer (120) and that acts as a bottom substrate layer or supporting base. Such substrate, which can also be called base print media substrate or base substrate or supporting substrate, contains a material that serves as a base upon which the ink receiving layers are applied and, eventually, the backing coating layer. The substrate provides integrity for the resultant printable media. The amount of the ink receiving layer, on the media, in the dry state, is, at least, sufficient to hold all of the ink that is to be applied to the media. The wording "cellulose based" refers herein to the fact that the substrate comprises cellulose fibers or cellulosic fibers. Examples of cellulose based substrates include substrates comprising, but not limited to, natural cellulosic material or synthetic cellulosic material (such as, for example, cellulose diacetate, cellulose triacetate, cellulose propionate, cellulose butyrate, cellulose acetate butyrate and nitrocellulose).

The cellulose base substrate could be made from pulp stock containing a fiber ratio (hardwood fibers to softwood fibers) of 70:30. The hardwood fibers have an average length ranging from about 0.5 mm to about 1.5 mm. These relatively short fibers improve the formation and smoothness of the base. Suitable hardwood fibers can include pulp fibers derived from deciduous trees (angiosperms), such as birch, aspen, oak, beech, maple, and eucalyptus. The hardwood fibers may be bleached or unbleached hardwood fibers. Rather than virginal hardwood fibers, other fibers with the same length, up to 20% of total hardwood fiber content, can be used as the hardwood fiber. The other fibers may be recycled fibers, non-deinkable fibers, unbleached fibers, synthetic fibers, mechanical fibers, or combinations thereof. The softwood fibers have an average length ranging from about 2 mm to about 7 mm. These relatively long fibers improve the mechanical strength of the base. Suitable softwood fibers can include pulp fibers derived from coniferous trees (gymnosperms), such as varieties of fir, spruce, and pine (e.g., loblolly pine, slash pine, Colorado spruce, balsam fir, and Douglas fir). The fibers may be prepared via any known pulping process, such as, for example, chemical pulping processes. Two suitable chemical pulping methods include the kraft process and the sulphite process.

The fibers of the substrate material may be produced from chemical pulp, mechanical pulp, thermal mechanical pulp, chemical mechanical pulp or chemical thermo-mechanical pulp. Examples of wood pulps include, but are not limited to, Kraft pulps and sulfite pulps, each of which may or may not be bleached. The substrate may also include non-cellulose fibers. The pulp used to make the cellulose base may also contain up to 10 wt % (with respect to total solids) of additives. Suitable additives may be selected from a group consisting of a dry strength additive, wet strength additive, a filler, a retention aid, a dye, an optical brightening agent (i.e., optical brightener), a surfactant, a sizing agent, a biocide, a defoamer, or a combination thereof. In some examples, the cellulose based substrate is a paper base substrate. The media substrate can also be an uncoated plain paper or a plain paper having a porous coating, such as a calendared paper, an un-calendared paper, a cast-coated paper, a clay coated paper, or a commercial offset paper.

The basis weight of the cellulose based substrate is dependent on the nature of the application of the printable recording media where lighter weights are employed for magazines, books and tri-folds brochures and heavier weights are employed for post cards and packaging applications, for example. The cellulose based substrate can have a basis weight of about 60 grams per square meter ($g/m^2$ or gsm) to about 400 gsm, or of about 100 gsm to about 250 gsm.

The Composite Ink Receiving Layer

The printable recording media comprises a cellulose based substrate (110) and, at least, a composite ink receiving layer (120) disposed on, at least, one side of the substrate. The ink receiving layer can also be referred to as an inkjet receiving or an ink recording layer or an image receiving layer. In some examples, the composite ink receiving layer is present on, at least, one side of the substrate (110). In some other examples, the composite ink receiving layer (120) is present on both sides of the substrate (110). The word "composite" refers herein to a material made from, at least, two constituent materials or layers, which have different physical and/or chemical properties from one another, and wherein these constituent materials/layers remain separate at a molecular level and distinct within the structure of the composite.

The composite ink receiving layer is formed with two distinct layers. The ink receiving layer, or coating, includes a first distinct layer (121) (also called herein "ink fixation layer") and a second distinct layer (122) (also called herein "ink fusion layer"). The second distinct layer (122) is applied on top of the first distinct layer (121). The word "distinct" refers herein to the fact that the layers have significant difference in coating thickness in Z-direction, for examples. In some examples, the first distinct layer and the second distinct layer of the composite ink receiving layer have a difference in coating thickness in Z-direction, between the first and the second layers, that is of, at least, 1:10; or, in some other examples, that is of, at least, 1:50, or, in yet some other examples, that is of, at least, 1:100. The composite ink receiving layer, that is formed with two distinct layers, can be considered as having two interfaces: one being the thickness of the layer (e.g., the Z-direction) and the other, being along the surface of the media, to which the image side that is to be printed (e.g., the X and Y directions).

The composite ink receiving layer (120) can be disposed on one side of the supporting substrate (110) and can form a layer having a coat-weight in the range of about 0.5 to about 30 gram per square meter ($g/m^2$ or gsm), or in the range of about 1 to about 20 gsm, or in the range of about 1 to about 15 gsm per side. In some examples, the printable recording media has a composite ink receiving layer (120) that is applied to only one side of the supporting substrate (110) and that has a coat-weight in the range of about 2 to about 10 gsm. In some other examples, the printable recording media contains composite ink receiving layers (120) that are applied to both sides of the substrate (110) and that have a coat-weight in the range of about 1 to about 10 gsm per side.

The composite ink receiving layer (120) comprises a first distinct layer or "ink fixation layer" (121). The first distinct layer that is applied directly on outmost surface of cellulose based substrate could be called "ink fixation layer" since one of the function of this layer is to be a physical layer to block ink colorants, also known as pigments movement, along the z-direction by electronic charging interaction. The electronic charging interaction refers to positively or negatively charged species, in the ink fixation layer, that can be coupled together with the opposite charged species, in the ink composition, that chemically and/or physically forms a neutralized pair. Without being linked by any theory, it is believed that the first distinct layer has multiple functions. First of all, it can be able, when receiving ink drops, to crash or to separate ink pigment from ink solvent. Secondly, it can be able to chemically and/or physically bond ink pigments and prevent pigments to further penetrate into the cellulose based substrate but let ink solvent vehicle flow into the base instantly. Not bonded to any theory, it is believed that migration of ink pigments into cellulose based substrate will decrease color gamut and therefore reduce printing quality. In addition, such interaction can also immobilize the ink colorants in order to reduce randomly colorant migration along the x-y direction, a less ink bleed and sharp edge definition image can thus be produced.

The first distinct layer or ink fixation layer (121), as described herein, does not include a "physical barrier layer" that will stop pigment migration towards base, i.e. layer that will "physically block" pigment migration along z-direction since these layers will also inevitably stop or reduce the ink solvent vehicle movement and, in turn, will reduce ink dry time. (Physical barrier layer refers to a continuous layer built up on media substrate). Examples of physical layers that are excluded include: coatings containing inorganic and/or organic fillers and binder(s) (which the filler/binder structure may block or substantially reduce the penetration of ink vehicles); coating layers made from film-forming polymers that form a continuous layer; layers that are made by applying polymeric substances (such as polyolefin like polyethylene and polypropylene using heated coating method such as extrusion coating); and coatings which are formed by laminating sheeted materials such as plastic-paper, fabric-paper and metal foil-paper together. In some examples, the thickness of the first distinct layer (121) is ranging from about 0.001 nanometers (nm) to about 100 nanometers (nm) out of the top surface of the cellulose based substrate.

In some examples, the thickness of the second distinct layer (122) (i.e. the ink fusion layer) is ranging from about 0.01 nanometers (nm) to about 10 micrometer (μm); or from about 0.001 micrometer (m) to about 5 micrometer (μm)); or from about 0.01 micrometer (μm) to about 1 micrometer (m) out of the top surface of the first distinct layer. The coat weight of the second distinct layer (122) can be ranging from about 0.5 gsm to about 15 gsm, or from about 1 gsm to no more than 10 gsm, for example from 5 to 8 gsm.

In some examples, the first distinct layer comprises an electrical charged substance. "Electrical charged" refers to chemical substance with some atoms gaining or losing one or more electrons or protons, together with a complex ion consists of an aggregate of atoms with opposite charge. The electrical charged substance is a charged ion or associated complex ion that can de-coupled in an aqueous environment. In some examples, the electrical charged substance is an electrolyte, having a low molecular species or a high molecular species. The electrical charged substance can be present, in the first distinct layer, in an amount representing from about 0.005 gram per square meter (gsm) to 1.5 gram per square meter (gsm) of the cellulose based substrate; or from about 0.2 gsm to about 0.8 gsm of the cellulose based substrate in another example. In some examples, the electrical charged substance is a water soluble, divalent or multi-valent metal salt. The term "water soluble" is meant to be understood broadly as a species that is readily dissolved in water. Thus, water soluble salts may refer to a salt that has a solubility greater than 15 g/100 g $H_2O$ at 1 Atm (at pressure and room temperature).

The electrical charged substance can be a water soluble metallic salt which means that the first distinct layer (121) comprises a water soluble metallic salt. The water soluble metallic salt can be an organic salt or an inorganic salt. The electrical charged substance can be an inorganic salt; in some examples, the electrical charged substance is a water-soluble and multi-valent charged salts. Multi-valent charged salts include cations, such as Group I metals, Group II metals, Group III metals, or transition metals, such as sodium, calcium, copper, nickel, magnesium, zinc, barium, iron, aluminum and chromium ions. The associated complex ion can be chloride, iodide, bromide, nitrate, sulfate, sulfite, phosphate, chlorate, acetate ions.

The electrical charged substance can be an organic salt; in some examples, the electrical charged substance is a water-soluble organic salt; in yet some other examples, the electrical charged substance is a water-soluble organic acid salt. Organic salt refers to associated complex ion that is an organic specifies, where cations may or may not the same as inorganic salt like metallic cations. Organic metallic salt are ionic compounds composed of cations and anions with a formula such as $(C_nH_{2n+1}COO^-M^+)*(H_2O)_m$ where $M^+$ is cation species including Group I metals, Group II metals, Group III metals and transition metals such as, for example, sodium, potassium, calcium, copper, nickel, zinc, magnesium, barium, iron, aluminum and chromium ions. Anion species can include any negatively charged carbon species with a value of n from 1 to 35. The hydrates ($H_2O$) are water molecules attached to salt molecules with a value of m from 0 to 20. Examples of water soluble organic acid salts include metallic acetate, metallic propionate, metallic formate, metallic oxalate, and the like. The organic salt may include a water dispersible organic acid salt. Examples of water dispersible organic acid salts include a metallic citrate, metallic oleate, metallic oxalate, and the like.

In some examples, the electrical charged substance is a water soluble, divalent or multi-valent metal salt. Specific examples of the divalent or multi-valent metal salt used in the coating include, but are not limited to, calcium chloride, calcium acetate, calcium nitrate, calcium pantothenate, magnesium chloride, magnesium acetate, magnesium nitrate, magnesium sulfate, barium chloride, barium nitrate, zinc chloride, zinc nitrate, aluminum chloride, aluminum hydroxychloride, and aluminum nitrate. Divalent or multi-valent metal salt might also include $CaCl_2$, $MgCl_2$, $MgSO_4$, $Ca(NO_3)_2$, and $Mg(NO_3)_2$, including hydrated versions of these salts. In some examples, the water soluble divalent or multi-valent salt can be selected from the group consisting of calcium acetate, calcium acetate hydrate, calcium acetate monohydrate, magnesium acetate, magnesium acetate tetrahydrate, calcium propionate, calcium propionate hydrate, calcium gluconate monohydrate, calcium formate and combinations thereof. In some examples, the electrical charged substance is calcium chloride and/or calcium acetate. In some other examples, the metal salt is calcium chloride.

The first distinct layer of the composite ink receiving layer might further comprise a polymeric binder. Examples of polymeric binder that can be used are described below since the binder can be selected from the group of binders described and used for the second distinct layer. The polymeric binder, present in the first distinct layer, is independently selected from the binder that used in the second distinct layer. In some examples, the polymeric binder can be either water a soluble, a synthetic or a natural substances or an aqueous dispersible substance like polymeric latex. In some other examples, the polymeric binder is polymeric latex. The polymeric binder can be a water soluble polymer or water dispersible polymeric latex.

The printable recording media comprises a cellulose based substrate and a composite ink receiving layer with a first and a second distinct layer. The second distinct layer is applied on top of the first distinct layer and contains, at least, a polymeric binder, nano-size inorganic pigment particles and an ionene compound. The "ionene compound" refers to a polymeric compound having ionic groups as part of the main chain, where ionic groups can exist on the backbone unit, or exist as the appending group to an element of the backbone unit, i.e. the ionic groups are part of the repeat unit of the polymer.

The second distinct layer comprises an ionene compound. The ionene compound can be present in an amount representing from about 0.5 to about 20 parts per 100 parts by total dry weight of the coating components present in the second distinct layer. In some other examples, the second distinct layer comprises an ionene compound in an amount representing from about 2 to about 15 parts per 100 parts by total dry weight of the coating components present in the second distinct layer. In some example, the ionene compound is a cationic charged polymer. The cationic ionene polymer can have a weight average molecular weight of 100 Mw to 8000 Mw. Examples of such cationic charged polymer include: poly-diallyl-dimethyl-ammonium chloride, poly-diallyl-amine, polyethylene imine, poly2-vinylpyridine, poly 4-vinylpyridine poly2-(tert-butylamino)ethyl methacrylate, poly 2-aminoethyl methacrylate hydrochloride, poly 4'-diamino-3,3'-dinitrodiphenyl ether, poly N-(3-aminopropyl)methacrylamide hydrochloride, poly 4,3,3'-diaminodiphenyl sulfone, poly 2-(iso-propylamino) ethylstyrene, poly2-(N,N-diethylamino)ethyl methacrylate, poly 2-(diethylamino)ethylstyrene, and 2-(N,N-dimethylamino)ethyl acrylate.

The ionene compound can be a naturally occurring polymer such as cationic gelatin, cationic dextran, cationic chitosan, cationic cellulose or cationic cyclodextrin. The ionene polymer can also be a synthetically modified naturally occurring polymer such as a modified chitosan, e.g., carboxymethyl chitosan or N, N, N-trimethyl chitosan chloride.

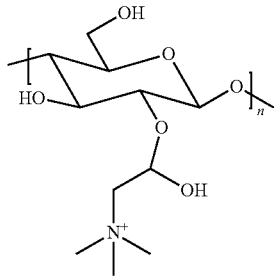

Chitosan

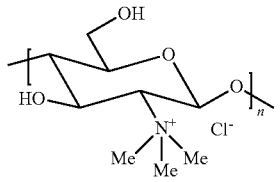

N, N, N-trimethyl chitosan chloride

In some examples, the ionene compound is a polymer having ionic groups as part of the main chain, where ionic groups exist on the backbone unit such as, for example, an alkoxylated quaternary polyamine having the Formula (I)

$$R^1—N^+(A)_2R—[N^+(A)(R)(R^1)]_m—N^+(A)_2R^1;(m+2)\ X.$$

where R, $R^1$ and A can be the same or different group such as linear or branched $C_2$-$C_{12}$ alkylene, $C_3$-$C_{12}$ hydroxy-alkylene, $C_4$-$C_{12}$ dihydroxy-alkylene or dialkyl-arylene; X can be any suitable counter ion, such as halogen or other similarly charged anions; and m is a numeral suitable to provide a polymer having a weight average molecular weight ranging from 100 Mw to 8000 Mw. In some examples, m is an integer ranging from 5 to 3000. The nitrogen can be quaternized in some examples.

In some other examples, the ionene compound is a polymer having ionic groups as part of the main polymer chain, but exist as the appending group to an element of the backbone unit. The ionic groups are not on the backbone but are part of the repeat unit of the polymer, such as quaternized poly(4-vinyl pyridine) of structure (II) below:

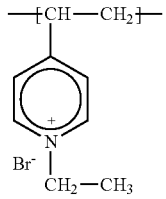

In this example, the above polymer can repeated in order to provide a polymer with a weight average molecular weight ranging from 100 Mw to 8000 Mw.

The ionene polymer can also be a cationic gelatin, cationic dextran, cationic chitosan, cationic cellulose, cationic cyclodextrin, carboxy-methyl chitosan, N,N,N-trimethyl chitosan chloride, alkoxylated quaternary polyamines, polyamines, polyamine salts, polyacrylate diamines, quaternary ammonium salts, polyoxyethylenated amines, quaternized polyoxyethylenated amines, poly-dicyandiamide, poly-diallyl-dimethyl ammonium chloride polymeric salt, quaternized dimethylaminoethyl(meth)acrylate polymers, polyethyleneimines, branched polyethyleneimines, quaternized poly-ethylenimine, polyurias, poly[bis(2-chloroethyl) ether-alt-1,3bis[3-(dimethylamino)propyl]urea], quaternized poly[bis(2-chloroethyl)ether-alt-1,3-bis[3-(dimethylamino)propyl], vinyl polymers or salts thereof, quaternized vinyl-imidazol polymers, modified cationic vinyl alcohol polymers, alkyl-guanidine polymers, or a combination thereof.

The ionene compound can be selected from the group consisting of polyamines and/or their salts, poly-acrylate diamines, quaternary ammonium salts, poly-oxyethylenated amines, quaternized poly-oxyethylenated amines, poly-dicyandiamide, poly-diallyl-dimethyl ammonium chloride polymeric salt and quaternized dimethyl-aminoethyl(meth) acrylate polymers.

In some examples, the ionene compound can include poly-imines compounds and/or their salts, such as linear polyethyleneimines, branched polyethyleneimines or quaternized poly-ethylene-imine. In some other examples, the ionene compound is a substitute of urea polymer such as poly[bis(2-chloroethyl)ether-alt-1,3 bis[3-(dimethylamino) propyl]urea] or quaternized poly[bis(2 chloro-ethyl)ether-alt-1,3-bis [3-(dimethylamino)propyl]. In yet some other examples, the ionene compound is a vinyl polymer and/or their salts such as quaternized vinyl-imidazol polymers, modified cationic vinyl-alcohol polymers, alkyl-guanidine polymers, and/or their combinations. The ionene compound can be a homopolymer of diallyl-dimethyl-ammonium chloride (poly-DADMA).

Commercially available ionene polymers can be found, for examples, under the tradename BTMS-50, Incroquat® CR or Induquat® ECR from Indulor Chemie GmbH (Germany); Floquat® serials from SFN Inc.; QUAB® serials from SKW QUAB Chemicals Inc.; Tramfloc® serials from Tramfloc Inc.; Zetag® serials from BASF and ZHENGLI® from ZLEOR Chemicals Ltd.

The second distinct layer contains nano-sized inorganic pigment particles: by "nano-sized" pigment particles, it is meant herein pigments, in the form of particle, that have an average particles size that in in the nanometer sizes ($10^{-9}$ meters). Said particle are considered as either substantially spherical or irregular. In some examples, the inorganic pigment particles have an average particle size in the range of about 1 to about 150 nanometer (nm); in some other examples, the inorganic pigment particles have an average particle size in the range of about 2 to about 100 nanometer (nm). In some examples, the surface area of the inorganic pigment particles is in the range of about 20 to about 800 square meter per gram or in the range of about 25 to about 350 square meter per gram. The surface area can be measured, for example, by adsorption using BET isotherm. In some examples, the inorganic pigment particles are pre-dispersed in a dispersed slurry form before being mixed with the composition for coating on the cellulose based substrate. An alumina powder can be dispersed, for example, with high share rotor-stator type dispersion system such as an Ystral system.

In some examples, the second distinct layer (or ink fusion layer) contains from about 40 wt % to about 95 wt % of nano-size inorganic pigment particles by total weight of the second distinct layer. In some other examples, the second distinct layer contains from about 65 wt % to about 85 wt % of nano-size inorganic pigment particles by total weight of the second distinct layer. In some examples, the nano-size inorganic pigment particles, of the second distinct layer, are metal oxide or complex metal oxide particles. As used herein, the term "metal oxide particles" encompasses metal oxide particles or insoluble metal salt particles. Metal oxide particles are particles that have high refractive index (i.e. more than 1.65) and that have particle size in the nano-range such that they are substantially transparent to the naked eye. The visible wavelength is ranging from about 400 to about 700 nm.

Examples of inorganic pigments include, but are not limited to, titanium dioxide, hydrated alumina, calcium carbonate, barium sulfate, silica, high brightness alumina silicates, boehmite, pseudo-boehmite, zinc oxide, kaolin clays, and/or their combination. The inorganic pigment can include clay or a clay mixture. The inorganic pigment filler can include a calcium carbonate or a calcium carbonate mixture. The calcium carbonate may be one or more of ground calcium carbonate (GCC), precipitated calcium carbonate (PCC), modified GCC, and modified PCC. The inorganic particles that can also be selected from the group consisting of aluminum oxide ($Al_2O_3$), silicon dioxide ($SiO_2$), nanocrystalline boehmite alumina (AlO(OH)) and aluminum phosphate ($AlPO_4$). In some other examples, the inorganic particles are aluminum oxide ($Al_2O_3$) or silicon dioxide ($SiO_2$). Example of such inorganic particles is for examples, Disperal® HP-14, Disperal® HP-16 and Disperal® HP-18 available from Sasol Co. In some examples, the nano-size inorganic pigment particles of the second distinct layer are calcium carbonate, aluminum oxide ($Al_2O_3$) or silicon dioxide ($SiO_2$). In some other examples, the nano-size inorganic pigment particles of the second distinct layer are calcium carbonate.

The nano-size inorganic pigment particles could also be a "colloidal solution" or "colloidal sol". Said colloidal sol is a composition that nano-size particles with metal oxide structure such as aluminum oxide, silicon oxide, zirconium oxide, titanium oxide, calcium oxide, magnesium oxide, barium oxide, zinc oxide, boron oxide, and mixture of two or more metal oxide. In some examples, such as the colloidal sol is a mixture of about 10 to 20 wt % of aluminum oxide and about 80 to 90 wt % of silicon oxide. In some examples, such as the colloidal sol is a mixture of about 14 wt % of aluminum oxide and about 86 wt % of silicon oxide. The nano-size inorganic pigment particles can be, in the aqueous solvent, either cationically or anionically charged and stabilized by various opposite charged groups such as chloride, sodium ammonium and acetate ions. Examples of colloidal sol are commercial available under the tradename Nalco 8676, Nalco 1056, Nalco 1057, as supplier by NALCO Chemical Company; or under the name Ludox®/Syton® such as Ludox® HS40 and HS30, TM/SM/AM/AS/LS/SK/CL-X and Ludox® TMA from Grace Inc.; or under the name Ultra-Sol 201A-280/140/60 from Eminess Technologies Inc.

The colloidal sol can also be prepared by using particles agglomerates which have the chemical structure as descripted above but which have starting particles size in the range of about 5 to 10 micrometer (10-6 meters). Such colloidal sol can be obtained by breaking agglomerates using chemical separation and mechanical shear force energy. Monovalent acids such as nitric, hydrochloric, formic or acetic with a PKa value of 4.0 to 5.0 can be used. Agglomerates are commercial available, for example, from Sasol, Germany under the tradename of Disperal® or from Dequenne Chimie, Belgium under the Dequadis® HP.

With regard to the nano-size inorganic pigment particles, the second distinct layer may further include second particles that have a size range that is at least 100 times bigger than the first nano-particles (i.e. nano-size inorganic pigment particles). Such second particles can be called inorganic spacer particles, and are added in order to improve the stability of the dispersion of the first particle, for example, ground calcium carbonate such as Hydrocarb® 60 available from Omya, Inc.; precipitated calcium carbonate such as Opacarb® A40 or Opacarb®3000 available from Specialty Minerals Inc. (SMI); clay such as Miragloss® available from Engelhard Corporation; synthetic clay such as hydrous sodium lithium magnesium silicate, such as, for example, Laponite® available from Southern Clay Products Inc., and titanium dioxide ($TiO_2$) available from, for example, Sigma-Aldrich Co. The second type of the particles (inorganic spacer particles) can be other kind particles or pigments. Examples of inorganic spacer particles include, but are not limited to, particles, either existing in a dispersed slurry or in a solid powder, of polystyrene and its copolymers, polymethyacrylates and their copolymers, polyacrylates and their copolymers, polyolefins and their copolymers, such as polyethylene and polypropylene, a combination of two or more of the polymers. The inorganic spacer particles may be chosen from silica gel (e.g., Silojet® 703C available from Grace Co.), modified (e.g., surface modified, chemically modified, etc.) calcium carbonate (e.g., Omyajet® B6606, C3301, and 5010, all of which are available from Omya, Inc.), precipitated calcium carbonate (e.g., Jetcoat® 30 available from Specialty Minerals, Inc.), and combinations thereof.

The second distinct layer contains at least one polymeric binder. Without being linked by any theory, it is believed that the polymeric binder is used to provide adhesion among the inorganic particles within the second distinct layer. The polymeric binder is also used to provide adhesion between the image first distinct layer and second distinct layer. In some examples, the polymeric binder is present in the second distinct layer in an amount representing from about 5 parts by dry weight to 25 parts by dry weight per 100 parts of nano particles.

The polymeric binder can be either water a soluble, a synthetic or a natural substances or an aqueous dispersible substance like polymeric latex. In some other examples, the polymeric binder is polymeric latex. The polymeric binder can be a water soluble polymer or water dispersible polymeric latex. The binder may be selected from the group consisting of water-soluble binders and water dispersible polymers that exhibit high binding power for base paper stock and pigments, either alone or as a combination. In some examples, the polymeric binder components have a glass transition temperature (Tg) ranging from −10° C. to +50° C. The way of measuring the glass transition temperature (Tg) parameter is described in, for example, Polymer Handbook, 3rd Edition, authored by J. Brandrup, edited by E. H. Immergut, Wiley-Interscience, 1989.

Suitable binders include, but are not limited to, water soluble polymers such as polyvinyl alcohol, starch derivatives, gelatin, cellulose derivatives, acrylamide polymers, and water dispersible polymers such as acrylic polymers or copolymers, vinyl acetate latex, polyesters, vinylidene chloride latex, styrene-butadiene or acrylonitrile-butadiene copolymers. Non-limitative examples of suitable binders include styrene butadiene copolymer, polyacrylates, polyvinyl acetates, polyacrylic acids, polyesters, polyvinyl alcohol, polystyrene, polymethacrylates, polyacrylic esters, polymethacrylic esters, polyurethanes, copolymers thereof, and combinations thereof. In some examples, the binder is a polymer and copolymer selected from the group consisting of acrylic polymers or copolymers, vinyl acetate polymers or copolymers, polyester polymers or copolymers, vinylidene chloride polymers or copolymers, butadiene polymers or copolymers, styrene-butadiene polymers or copolymers, acrylonitrile-butadiene polymers or copolymers. In some other examples, the binder component is a latex containing particles of a vinyl acetate-based polymer, an acrylic polymer, a styrene polymer, an SBR-based polymer, a polyester-based polymer, a vinyl chloride-based polymer, or the like. In yet some other examples, the binder is a polymer or a copolymer selected from the group consisting of acrylic polymers, vinyl-acrylic copolymers and acrylic-polyurethane copolymers. Such binders can be polyvinylalcohol or copolymer of vinylpyrrolidone. The copolymer of vinylpyrrolidone can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate, and methyl vinylketone, etc. Examples of binders include, but are not limited to, polyvinyl alcohols and water-soluble copolymers thereof, e.g., copolymers of polyvinyl alcohol and poly(ethylene oxide) or copolymers of polyvinyl alcohol and polyvinylamine; cationic polyvinyl alcohols; aceto-acetylated polyvinyl alcohols; polyvinyl acetates; polyvinyl pyrrolidones including copolymers of polyvinyl pyrrolidone and polyvinyl acetate; gelatin; silyl-modified polyvinyl alcohol; styrene-butadiene copolymer; acrylic polymer latexes; ethylene-vinyl acetate copolymers; polyurethane resin; polyester resin; and combination thereof. Examples of binders include Poval® 235, Mowiol® 56-88, Mowiol® 40-88 (products of Kuraray and Clariant).

The binder may have an average molecular weight (Mw) of about 5,000 to about 500,000. In some examples, the binder has an average molecular weight (Mw) ranging from about 100,000 to about 300,000. In some other examples, the binder has an average molecular weight of about 250,000. The average particle diameter of the latex binder can be from about 10 nm to about 10 μm; in some other examples, from about 100 nm to about 5 μm; and, in yet other examples, from about 500 nm to about 0.5 μm. The particle size distribution of the binder is not particularly limited, and either binder having a broad particle size distribution or binder having a mono-dispersed particle size distribution may be used. The binder may include, but is in no way limited to latex resins sold under the name Hycar® or Vycar® (from Lubrizol Advanced Materials Inc.); Rhoplex® (from Rohm & Hass company); Neocar® (from Dow Chemical Comp); Aquacer® (from BYC Inc) or Lucidene® (from Rohm & Haas company).

In some examples, the binder is selected from natural macromolecule materials such as starches, chemical or biological modified starches and gelatins. The binder could be a starch additive. The starch additive may be of any type, including but not limited to oxidized, ethylated, cationic and pearl starch. In some examples, the starch is used in an aqueous solution. Suitable starches that can be used herein are modified starches such as starch acetates, starch esters, starch ethers, starch phosphates, starch xanthates, anionic starches, cationic starches and the like which can be derived by reacting the starch with a suitable chemical or enzymatic reagent. In some examples, the starch additives can be native starch, or modified starches (enzymatically modified starch or chemically modified starch). In some other examples, the starches are cationic starches and chemically modified starches. Useful starches may be prepared by known techniques or obtained from commercial sources. Examples of suitable starches include Penford Gum-280 (commercially available from Penford Products), SLS-280 (commercially available from St. Lawrence Starch), the cationic starch CatoSize 270 (from National Starch) and the hydroxypropyl No. 02382 (from Poly Sciences). In some examples, a suitable size press/surface starch additive is 2-hydroxyethyl starch ether, which is commercially available under the tradename Penford® Gum 270 (available from Penford Products). In some examples, due to strong tendency of re-agglomeration of the nano particles due to change of ionic strength, the binder is a non-ionic binder. Examples of such binders are commercially available, for example, from Dow Chemical Inc. under the tradename Aquaset® and Rhoplex® emulsions, or are polyvinyl alcohol commercially available from Kuraray American Inc. under the tradename Poval®, Mowiol® and Mowiflex®.

In addition to the above-described components, the first distinct layer and/or the second distinct layer formulations might also contain other components or additives, as necessary, to carry out the required mixing, coating, manufacturing, and other process steps, as well as to satisfy other requirements of the finished product, depending on its intended use. The additives include, but are not limited to, one or more of rheology modifiers, thickening agents, cross-linking agents, surfactants, defoamers, optical brighteners, dyes, pH controlling agents or wetting agents, and dispersing agents, for example. The total amount of additives, in the composition for forming the first distinct layer, can be from about 0.1 wt % to about 10 wt % or from about 0.2 wt % to about 5 wt %, by total dry weight of the ink receiving layer. In some examples, additives such as binders, deformers and PH adjusters can be added into the first distinct layer formulation in order to improve functional performances such as eliminating foaming during coating process.

Backing Coating Layer

In some examples, the printable recording media can further comprise a backing coating layer (130). The backing coating layer can also be called "curl control layer" since it primary function might be to balance the stress generated from the ink receiving layer, and provide a good control of the curl effect of the media. The backing coating layer can be applied directly on the cellulose based substrate (110) on the opposite side of the ink receiving layer (120), i.e. on the side that will not receive any printed image. Said opposite side can also be called "non-imaging side" or backside. The backing coating layer (130) will not receive any image but will help the media to balance coating stress in order to prevent media curling. When present, the backing coating layer can have a coat weight ranging from about 1.0 gsm or from about 15 gsm. In some examples, the backing coating layer comprises at least one polymeric binder and, at least, a micro-size inorganic pigment particle. In some other examples, the backing coating layer comprises at least one polymeric binder and, at least, a nano-size inorganic pigment particle which is similar to the second distinct layer as described above.

Method of Making a Printable Recording Media

In some examples, according to the principles described herein, a method of making a printable recording media comprising a cellulose based substrate (110) and composite ink receiving layer (120) is provided. Such method encompasses: providing a cellulose based substrate (110); applying a first distinct layer (121); drying said a first distinct layer (121); applying a second distinct layer (122) containing, at least, a polymeric binder, nano-size inorganic pigment particles and an ionene compound, on top of the first distinct layer, and drying said second distinct layer (122) in order to obtain a composite ink receiving layer (120) and the printable recording media (100). In some examples, a backing coating layer (130) is applied to the non-imaging side of the media, i.e. on the opposing side of the ink receiving layer (120). In some other examples, the printable recording media can be calendered in order to obtain the desired gloss and smoothness.

FIG. 4 is a flow chart of a method (200) for making the printable recording media according to the present disclosure. In this method, a cellulose based substrate is provided (201); then a first distinct layer is applied (202) and then dried (203). A second distinct layer is applied over the first distinct layer (204) and, then, said second distinct layer is dried (205) in order to obtain an ink receiving layer that will form the coated printable recording media (206). In some examples, the composite ink receiving layer (120), made of the two distinct layers, is applied to the cellulose based substrate (110) on one side (on the image receiving side) of the media. In some other examples, the ink receiving layer (120) is applied to both sides of the substrate (110) (on the image receiving side and on the backside). The two distinct layers that form the ink receiving layer (120) are applied as two separate layers.

The first distinct layer (121) or ink fixation layer, can be applied to the cellulose based substrate (HO) by using one of a variety of suitable coating methods, for example blade coating, air knife coating, metering rod coating, size press, curtain coating, or another suitable technique. For example, the ink fixation layer may be applied using a conventional off-line coater, or use an online surface sizing unit, such as a puddle-size press, film-size press, or the like. The puddle-size press may be configured as having horizontal, vertical, and inclined rollers. In another example, the film-size press may include a metering system, such as gate-roll metering, blade metering, Meyer rod metering, or slot metering. For some examples, a film-size press with short-dwell blade metering may be used as application head to apply coating solution. The non-contact coating method example, the spray coating, is also suitable for this application.

The second distinct layer (122) is then applied over the ink fixation layer (121) or first distinct layer, in order to produce the ink receiving layer (120), using the coating method described above. In some examples, after the coating steps, the media might go through a drying process to remove water and other volatile components present in the layers and substrate. The drying pass may comprise several different drying zones, including, but not limited to, infrared (IR) dryers, hot surface rolls, and hot air floatation boxes. In some other examples, after the coating and drying steps, the coated web may receive a glossy or satin surface with a calendering or super calendering step. When a calendering step is desired, the coated product passes an on-line or off-line calender machine, which could be a soft-nip calender or a super-calender. The rolls, in the calender machine, may or may not be heated, and certain pressure can be applied to calendering rolls. In addition, the coated product may go through embosser or other mechanical roller devices to modify surface characteristics such as texture, smoothness, gloss, etc.

When the base substrate is base paper stock, the composition for forming the ink receiving layer can be applied on the base paper stock by an in-line surface size press process such as a puddle-sized press or a film-sized press, for example. In addition to in-line surface sizing processing, off-line coating technologies can also be used to apply the composition for forming the ink receiving layer to the print media substrate. Examples of suitable coating techniques include, but are not limited to, slot die coaters, roller coaters, fountain curtain coaters, blade coaters, rod coaters, air knife coaters, gravure applications, and air brush applications, for example.

Method for Producing Printed Images

A method for producing printed images, or printing method, includes providing a printable recording media such as defined herein comprising a cellulose based substrate and a composite ink receiving layer with a first and a second distinct layer, wherein the second distinct layer is applied on top of the first distinct layer and contains, at least, a polymeric binder, nano-size inorganic pigment particles and an ionene compound; applying an ink composition on the ink receiving coating layer of the print media, to form a printed image; and drying the printed image in order to provide, for example, a printed image with enhanced quality. In some examples, the ink is a pigment-based ink and/or a dye-based ink. In some other examples, the ink is a dye-based ink.

In some examples, the printing method for producing images is an inkjet printing method. By inkjet printing method, it is meant herein a method wherein a stream of droplets of ink is jetted onto the recording substrate or media to form the desired printed image. The ink composition may be established on the recording media via any suitable inkjet printing technique. Examples of inkjet method include methods such as a charge control method that uses electrostatic attraction to eject ink, a drop-on-demand method which uses vibration pressure of a Piezo element, an acoustic inkjet method in which an electric signal is transformed into an acoustic beam and a thermal inkjet method that uses pressure caused by bubbles formed by heating ink. Non-limitative examples of such inkjet printing techniques include thus thermal, acoustic and piezoelectric inkjet printing. In some examples, the ink composition is applied onto the recording media using inkjet nozzles. In some other examples, the ink composition is applied onto the recording method using thermal inkjet printheads. In some examples, the printing method as described herein prints on one-pass only. The paper passes under each nozzle and printhead only one time as opposed to scanning type printers where the printheads move over the same area of paper multiple times and only a fraction of total ink is used during each pass. The one-pass printing puts 100% of the ink from each nozzle/printhead down all at once and is therefore more demanding on the ability of the paper to handle all of the ink in a very short amount of time.

As mentioned above, a printable recording media in accordance with the principles described herein may be employed to print images on one or more surfaces of the print media. In some examples, the method of printing an image includes depositing ink that contains either particulate colorants or dye colorants. A suitable inkjet printer, according to the present method, is an apparatus configured to perform the printing processes. The printer may be a single pass inkjet printer or a multi-pass inkjet printer.

EXAMPLES

Ingredients:

TABLE 1

| Ingredient name | Nature of the ingredient | Supplier |
|---|---|---|
| Calcium Chloride | electrical charged substance | Sigma-Aldrich |
| Penford ® 280 | binder | Penford Inc |
| Hydrocarb ® H60 | inorganic pigment particulates (GCC) | Omya Inc. |
| Flexbond ® 325 | polymeric binder | Rosco |
| Foamaster ® VF | defoamer | BASF |
| Dynwet ® 800 | surfactant | BYK Inc. |
| Mowiol ® 6-98 | polyvinyl alcohol (PVA) binder | Kurraray |
| Mowiol ® 40-88 | polyvinyl alcohol (PVA) binder | Kurraray |
| Disperal ® HP-14 | inorganic pigment particulates (Alumina) | Sasol Co. |
| Superfloc ® C-500 | ionene compounds | Kemira Inc |

Example 1—Cellulose Based Substrate

The base substrate (110) with a basis weight of 165 gsm is provided. The base is made of fibers pulp that contains about 80% hardwood fibers and 20 about % soft wood fibers. The base also contains about 11 wt % inorganic fillers (mixture of carbonates titanium dioxide and clays). The filler is added to the fiber structure of the raw base at wet end.

Example 2—Ink Receiving Layer Formulations

Formulations of the first and second distinct layers (ink fixation layer and ink fusion layer), that form the ink receiving layer (120), are expressed in the Tables 2 and 3 below. The numbers represent the dry parts of each components present in each layer.

TABLE 2

| | First distinct layer ink fixation layer | | |
|---|---|---|---|
| | B1 | B2 | B3 (comparative) |
| Calcium Chloride | 1 | 1 | — |
| Penford 280 | — | 16 | — |
| Hydrcarb ® H60 | — | — | 100 |
| Flexbond ® 325 | — | — | 12 |
| Foamaster ® VF | — | — | 0.3 |
| Dynewet ® 800 | — | — | 0.5 |
| Mowiol ® 6-98 | — | — | 5 |
| Water | 99 | 83 | 40 |

TABLE 3

| | Second distinct layer ink fusion layer | |
|---|---|---|
| | F1 | F2 (Comparative) |
| Foamaster ®VF | 0.2 | 0.2 |
| Dynewet ® 800 | 1 | 1 |
| Superfloc ® C-500 | 3 | — |
| Disperal ® HP-14 | 100 | 100 |
| Mowiol ® 40-88 | 10 | 10 |

Example 3—Printable Recording Media

Series of coated media samples (samples 1 to 4) are prepared by coating the media substrate (110) with ink receiving layers prepared with the first distinct layer (ink fixation layer) and the second distinct layer (ink fusion layer) coating compositions as exemplified in Tables 2 and 3. A first distinct layer, or ink fixation layer, composition (B1 or B2), as exemplified in Table 2, is applied to one side of a cellulose base (110) at a coat-weigh of about 1 to 3 gsm. Composition B3 (comparative composition) is applied with a coat weight of 10 gsm. On top of this first distinct layer, the second layer (or ink fusion layer) F1 or F2 is applied, as exemplified in Table 3, at a coat-weigh of about 7 gsm. A back coating is applied at a coat-weigh of 5 gsm, on the opposite side of the base substrate (110). Said back coating (BC) has the formulation of F1.

The layer are applied using a Mayer rod and then dried. The media are then calendered through a two-nip soft nip calendering machine (at 100 kN/m, 54.4° C. (130° F.)) in order to obtain the coated printable recording media sample (1) to (4). The composition of the obtained printable recording media samples (Sample 1 to Sample 4) are illustrated in Table 4.

TABLE 4

| | First distinct layer - ink fixation layer - | Second distinct layer - ink fusion layer - | Back coating |
|---|---|---|---|
| Sample 1 | B1 | F1 | F1 |
| Sample 2 | B2 | F1 | F1 |
| Sample 3 (comparative) | B3 | F1 | F1 |
| Sample 4 (comparative) | B1 | F2 | F1 |

Example 4—Printable Recording Media Performances

An identical image sequence is printed on the printable media samples 1 to 4. The different recording media samples (1 to 4) are measured for different parameters and properties. After printing, the image quality of the prints and resistance are evaluated. Some qualities are presented with numeric value and some qualities are presented with visual rating score according to a 1 to 5 scale (wherein 1 means the worst performance and 5 represents the best performance). The results of these tests are expressed in Table 5 below.

Gamut Measurement (Gamut) represents the amount of color space covered by the ink on the media. Gamut volume is calculated using L*a*b* values of 8 colors (cyan, magenta, yellow, black, red, green, blue, white) measured with an X-RITE®939 Spectro-densitometer (X-Rite Corporation), using D65 illuminant and second observer angle.

L*min value testing is carried out on a black printed area and is measured with an X-RITE® 939 Spectro-densitometer, using D65 illuminant and second observer angle. This measure determines how "black" the black color is. A lower score indicates a better performance. Durability tests (Resistance tests) are performed onto the printed media under conditions that simulated outdoor weathering and abrasion. The media are tested for "dry rub resistance" and "wet rub resistance". Dry Rub and Wet Rub resistance tests refer to the ability of a printed image to resist appearance degradation upon dry or wet rubbing the image (simulation rubbing with dry or wet fingers). Good rub resistance, upon rubbing, will tend not to transfer ink from a printed image to surrounding areas where the ink has not been printed and the black optical density (KOD) will be maintained. "Dry Rub" tests are performed with a "Taber Eraser dry rub" that is applied 3 cycles with 350 g weight to the media at 2 inch linear stroke. The cycles are made with the eraser in the black area fill print. The "Wet Rub" tests are performed with Taber Linear Abrader with a plastic rubbing tip wrapped with a wet cloth. The water rub test is used with a water wet cloth, 2 inch linear stroke is made across the print with the cloth wrapped tip set with 350 g weight and 1 cycle is applied. Each durability testing item is then given a rating score according to a 1 to 5 scale, wherein 1 means the worst performance (all the ink in the image has been removed), and 5 represents the best performance (the image shows no damage).

TABLE 5

| Media Sample | Printer type | Print Conditions/Profile | Gamut | L* min | dry rub resistance | wet rub resistance |
|---|---|---|---|---|---|---|
| Sample 1 | T1200 - Dye printer | HP HW coated paper profile - Best Mode | 374K | 16.2 | 4 | 2.5 |
| Sample 4 | T1200 - Dye printer | Print Profile: HP HW coated paper profile - Best Mode | 360K | 15.8 | 4 | 1 |
| Sample 1 | L65000 - latex printer | HP PVC - free wall paper profile | 273K | N/A | 4.5 | 5 |
| Sample 4 | L65000 - latex printer | HP PVC - free wall paper profile | 271K | N/A | 5 | 5 |

Such results demonstrates that printable recording media according to the present disclosure show improved color gamut performances and have improved water resistance when used on dye based printers while still having good performance when used with latex printers.

The invention claimed is:

1. A printable recording media comprising:

a cellulose based substrate; and a composite ink receiving layer with a first distinct layer and a second distinct layer, wherein:

the second distinct layer is applied on top of the first distinct layer; and the second distinct layer contains, at least, a polymeric binder, nano-size inorganic pigment particles having an average particle size ranging from about 5 nm to about 150 nm, inorganic spacer particles having an average particle size that is at least 100 times bigger than the nano-size inorganic pigment particles, and an ionene compound.

2. The printable recording media, according to claim 1, wherein the first distinct layer and the second distinct layer of the composite ink receiving layer have a difference in coating thickness, in Z-direction, that is, at least, 1:10.

3. The printable recording media, according to claim 1, wherein the first distinct layer of the composite ink receiving layer comprises an electrical charged substance.

4. The printable recording media, according to claim 3, wherein the electrical charged substance is a water soluble, divalent or multi-valent metallic salt having a cation selected from the group consisting of sodium, calcium, copper, nickel, magnesium, zinc, barium, iron, aluminum, and chromium, and having an anion selected from the group consisting of chloride, iodide, bromide, nitrate, sulfate, sulfite, phosphate, chlorate, and acetate.

5. The printable recording media, according to claim 4, wherein the first distinct layer of the composite ink receiving layer further comprises a polymeric binder.

6. The printable recording media, according to claim 1, wherein in the second distinct layer of the composite ink receiving layer, the ionene compound is a cationic charged polymer.

7. The printable recording media, according to claim 1, wherein in the second distinct layer of the composite ink receiving layer, the ionene compound is present in an amount representing from about 0.5 to about 20 parts per 100 parts by total dry weight of the coating components present in the second distinct layer.

8. The printable media, according to claim 1, wherein, in the second distinct layer of the composite ink receiving layer, the ionene compound is cationic gelatin, cationic dextran, cationic chitosan, cationic cellulose, cationic cyclodextrin, carboxy-methyl chitosan, N,N,N-trimethyl chitosan chloride, alkoxylated quaternary polyamines, polyamines, polyamine salts, polyacrylate diamines, quaternary ammonium salts, polyoxyethylenated amines, quaternized polyoxyethylenated amines, poly-dicyandiamide, poly-diallyl-dimethyl ammonium chloride polymeric salt, quaternized dimethylaminoethyl(meth)acrylate polymers, polyethyleneimines, branched polyethyleneimines, quaternized poly-ethylenimine, polyurias, poly[bis(2-chloroethypether-alt-1,3bis[3-(dimethylamino)propyl]urea], quaternized poly[bis(2-chloroethypether-alt-1,3-bis[3-(dimethylamino)propyl], vinyl polymers or salts thereof, quaternized vinyl-imidazol polymers, modified cationic vinyl alcohol polymers, alkyl-guanidine polymers, or a combination thereof.

9. The printable recording media, according to claim 1, wherein in the second distinct layer of the composite ink receiving layer, the ionene compound is selected from the group consisting of polyamines and/or their salts, poly-acrylate diamines, quaternary ammonium salts, poly-oxyethylenated amines, quaternized poly-oxyethylenated amines, poly-dicyandiamide, poly-diallyl-dimethyl ammonium chloride polymeric salt and quaternized dimethyl-amino-ethyl(meth)acrylate polymers.

10. The printable recording media, according to claim 1, wherein in the second distinct layer of the composite ink receiving layer, the ionene compound is a homopolymer of diallyl-dimethyl-ammonium chloride.

11. The printable recording media, according to claim 1, wherein the second distinct layer of the composite ink receiving layer contains from about 40 wt % to about 95 wt % of nano-size inorganic pigment particles by total weight of the second distinct layer.

12. The printable recording media, according to claim 1, wherein, in the second distinct layer of the composite ink receiving layer, the nano-size inorganic pigment particles are metal oxide or complex metal oxide particles.

13. The printable recording media, according to claim 1, wherein in the second distinct layer of the ink receiving layer, the nano-size inorganic pigment particles are calcium carbonate, aluminum oxide or silicon dioxide.

14. The printable recording media, according to claim 1, wherein the composite ink receiving layer is applied on one side of the cellulose based substrate and a backing coating layer is applied on the other side of the cellulose based substrate.

15. A method for making a printable recording media comprising:

a. providing a cellulose based substrate;

b. applying a first distinct layer;

c. drying said first distinct layer;

d. applying a second distinct layer containing, at least, a polymeric binder, nano-size inorganic pigment particles having an average particle size ranging from about 5 nm to about 150 nm, inorganic spacer particles having an average particle size that is at least 100 times bigger than the nano-size inorganic pigment particles, and an ionene compound, on top of the first distinct layer;

e. drying said second distinct layer in order to obtain a composite ink receiving layer and the printable recording media.

16. The method, according to claim 15, wherein the first distinct layer includes a water soluble, divalent or multivalent metallic salt having a cation selected from the group consisting of sodium, calcium, copper, nickel, magnesium, zinc, barium, iron, aluminum, and chromium, and having an anion selected from the group consisting of chloride, iodide, bromide, nitrate, sulfate, sulfite, phosphate, chlorate, and acetate.

17. The method, according to claim 16, wherein the first distinct layer includes a polymer binder.

* * * * *